US006523826B1

(12) United States Patent
Matos

(10) Patent No.: US 6,523,826 B1
(45) Date of Patent: Feb. 25, 2003

(54) FOLDING PICTURE PUZZLE WITH DECODING LENSES AND ENCODED IMAGES

(76) Inventor: Jose R. Matos, P.O. Box 250647, Plano, TX (US) 75025-0647

( * ) Notice: Subject to any disclaimer, the term of this patent is extended or adjusted under 35 U.S.C. 154(b) by 0 days.

(21) Appl. No.: 09/613,221

(22) Filed: Jul. 10, 2000

Related U.S. Application Data

(60) Provisional application No. 60/143,271, filed on Jul. 12, 1999.

(51) Int. Cl.[7] ..... D63F 9/08
(52) U.S. Cl. ..... 273/155
(58) Field of Search ..... 273/157 R, 155; 359/463

(56) References Cited

U.S. PATENT DOCUMENTS

| | | | | |
|---|---|---|---|---|
| 847,545 A | | 3/1907 | Braine | |
| 2,092,583 A | | 9/1937 | Michael | |
| 2,327,875 A | | 8/1943 | Edborg | |
| 2,327,876 A | | 8/1943 | Edborg | |
| 2,655,382 A | | 10/1953 | Belsky | |
| 3,538,632 A | * | 11/1970 | Anderson | 359/478 |
| 3,645,534 A | | 2/1972 | Weisbecker | |
| 4,170,355 A | | 10/1979 | Finkin | |
| 4,588,210 A | | 5/1986 | Tabatch et al. | |
| 4,935,335 A | * | 6/1990 | Fotland | 359/463 |
| 5,445,380 A | | 8/1995 | Polsky | |
| 5,543,964 A | * | 8/1996 | Taylor et al. | 359/463 |
| 5,564,704 A | | 10/1996 | Yang | |
| 5,568,313 A | * | 10/1996 | Steenblik et al. | 359/463 |
| 5,735,520 A | | 4/1998 | Matos | |
| 5,759,328 A | | 6/1998 | Richwine et al. | |

* cited by examiner

*Primary Examiner*—Steven Wong
(74) *Attorney, Agent, or Firm*—Rick Matos; Innovar, L.L.C.

(57) ABSTRACT

The present invention is a picture puzzle comprising one or more combination decoding lens/encoded image portions which can form one or more assembled decoded images. The picture puzzle can also include one or more image portions that are not encoded. By proper placement and sizing of one or more apertures in the puzzle, it can be made into a fold-through picture puzzle, fold-through picture puzzle book or a fold-through 3-dimensional puzzle or object. A wide range of puzzle constructions can be made according to the invention. Assembled decoded images can be formed from a first combination decoding lens/encoded image portion paired with either a second combination decoding lens/encoded image portion or an image portion that is not encoded.

29 Claims, 8 Drawing Sheets

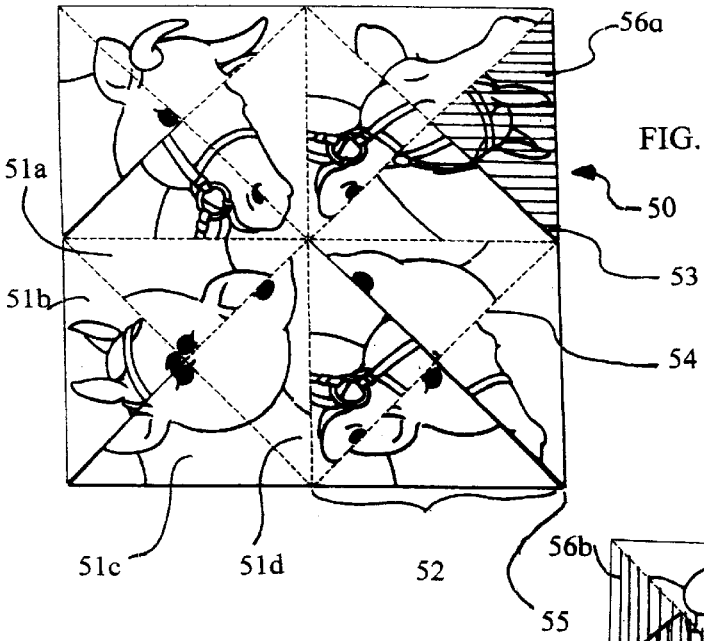
FIG. 5a
FIG. 5b
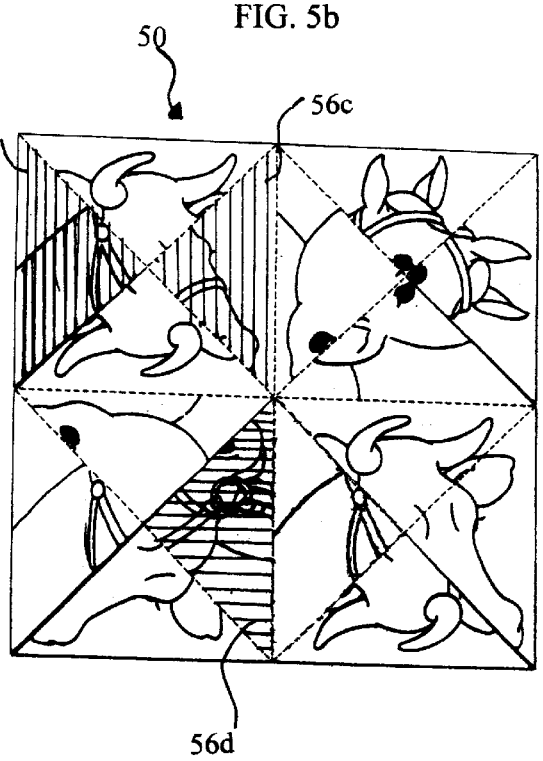
FIG. 6
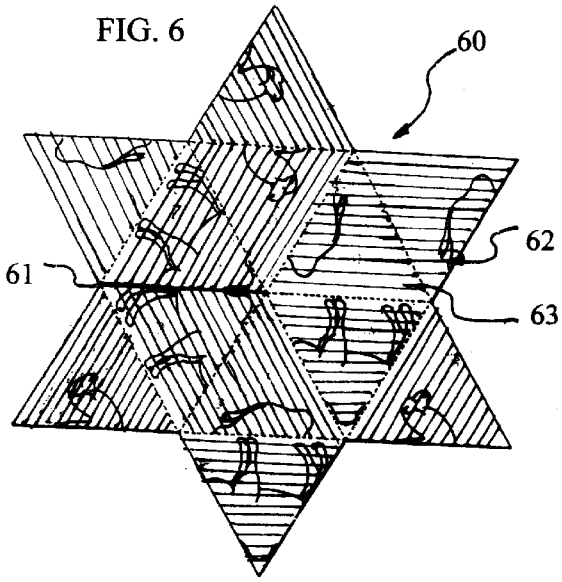

FIG. 7a
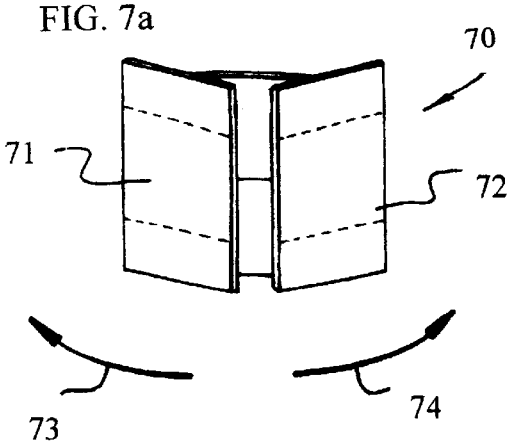
FIG. 7b
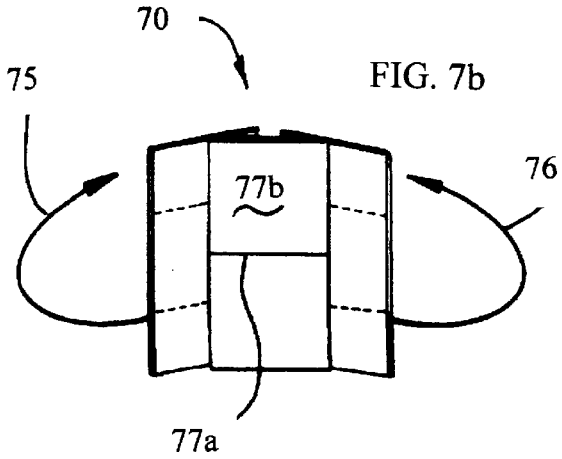
FIG. 7d
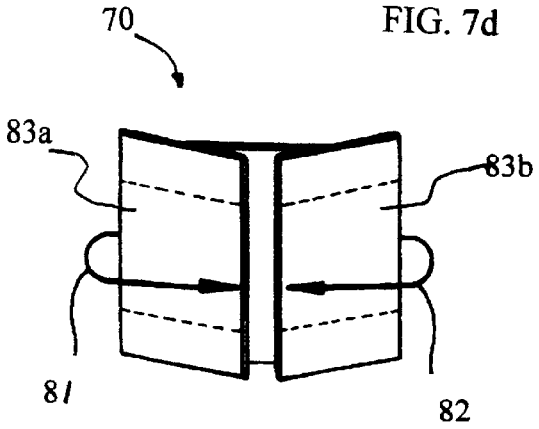
FIG. 7c
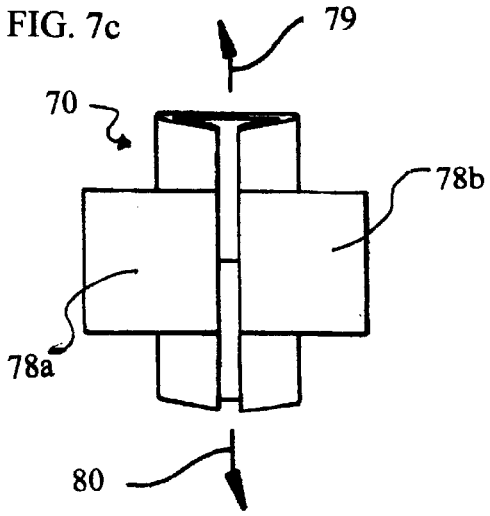
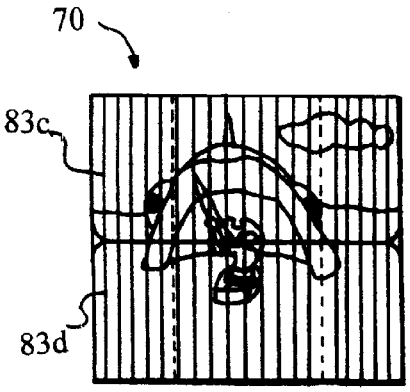
FIG. 8a
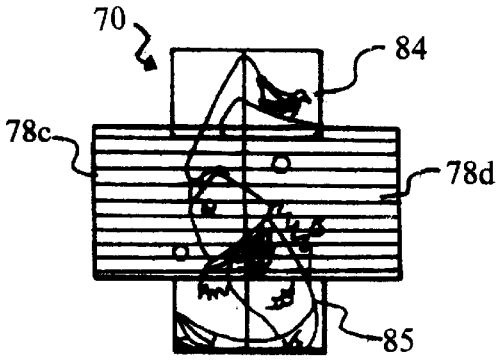
FIG. 8b

FOLDING PICTURE PUZZLE WITH DECODING LENSES AND ENCODED IMAGES

This application claims the benefit of Provisional Application Ser. No. 60/143,271, filed Jul. 12, 1999.

FIELD OF THE INVENTION

The present invention relates generally to folding puzzles, and more specifically, to folding puzzles comprising decoding lenses and encoded images. The folding puzzles are capable of being folded in a variety of ways to generate assembled decoded images from combination decoding lens lens/encoded image portions.

BACKGROUND OF THE INVENTION

Folding picture puzzles are well known in the entertainment, amusement and toy industry. There is always a demand for new, more challenging puzzles with enhanced aesthetic appeal to provide users with more entertainment.

Folding picture puzzles generally form an assembled image from a group of image portions distributed on a sheet. By folding the paper along a series of predetermined fold-lines, distributed image portions form a desired assembled image. By employing a variety of predetermined folding patterns and different image portions, a variety of assembled images can be formed.

U.S. Pat. Nos. 2,327,875 and 2,327,876 to H. Edborg, U.S. Pat. No. 2,655,382 to C. Belsky, U.S. Pat. No. 4,170,355 to S. Finkin, U.S. Pat. No. 5,445,380 to N. Polsky, U.S. Pat. No. 5,735,520 to Matos, and U.S. Pat. Nos. 5,759,328 and 5,833,789 both to Rosendale et al. are all directed to folding picture puzzles of a variety of constructions. The disclosures of these patents are hereby incorporated by reference in their entirety.

The Edborg patents depict two embodiments of a folding picture puzzle. The '876 patent covers a six-pointed star shaped puzzle having plural fold-lines and a single incision extending from the center to the outer periphery of the star. The puzzle comprises a single two-sided sheet of paper having image portions distributed on upper and lower surfaces. By folding the papers in a variety of ways, different assembled images are formed. The '875 patent covers a square shaped puzzle having plural fold-lines and four incisions. Each incision extends from the outer periphery of the paper toward the interior of the paper. Although the construction between the two embodiments is different, they operate in essentially the same manner.

The '382 patent to Belsky discloses a folding picture puzzle comprising a single sheet having a variety of fold-lines thereon, so that when the paper is folded along those lines, a particular assembled image is formed. The folded paper toy assumes a rectangular form when folded.

The Finkin patent is directed to an educational folding picture puzzle comprising a single sheet having defined portions, the portions being a central planar portion and a plurality of arm members extending from the edges of the central planar portion. Again, by folding this paper along any of a variety of creases, a variety of assembled images are formed.

The '380 patent to Polsky discloses a folding picture puzzle comprising a single two-sided sheet of paper having a patchwork of partial picture images printed on at least one side, the paper being divided into at least sixteen equal uniform squares by a combination of eight incisions and plural creases or fold-lines. The incisions extend from the outer periphery of the square inward. By folding along the incisions or creases, a variety of complete individual images can be formed. Depending on the way the patchwork of picture images is printed on the surface of the puzzle, this type of puzzle can form eight to about thirty-two assembled images.

The '520 patent to Matos discloses a unique fold-through puzzle known as the RIKIGAMI™ puzzle comprising one or more sheets having a plurality of image portions printed on at least one side of the sheet. The puzzle has a centrally located aperture through which the surrounding peripheral image bearing portions are adapted to pass. As the puzzle is folded toward the central aperture, assembled images are formed. Depending on the shape of the sheet, the number of sheets and the particular fold pattern selected, this type of puzzle can form four to about thirty-six or more assembled images.

The '328 and '789 patents to Rosendale et al. disclose another fold-through puzzle known as the FLAPPER™ puzzle which comprises four sheets that are affixed to one another in paired overlapping arrangement. As with the other puzzles, the sheets bear image portions that form assembled images when they are brought together. This type of puzzle can only form four assembled images.

None of the known folding puzzles bear more than one image per puzzle section. Accordingly, the maximum number of image portions borne by any of the known puzzles is equal to the total number of puzzle sections that comprise the puzzle. It would be preferred to have a puzzle that has a greater number of image portions than it has of puzzle sections thereby increasing the number of assembled images that can be formed by the puzzle without increasing the number of puzzle sections the puzzle has. A puzzle of this preferred construction would have improved versatility and would provide more entertainment than known puzzles.

Lenticular image products are well known. These products comprise an overlying lenticular lens that decodes an underlying and attached lenticular image. By viewing the lenticular article in different positions, a viewer will see two or more different decoded lenticular images beneath the lenticular lens. Lenticular lenses affixed to respective substrates bearing respective lens-resolvable linear-patterned encoded images are commercially available. The lines from the patterned image must be in alignment with the lenticules of the lenticular lens in order to form a readily viewable resolved image. Known lenticular lens/patterned image-bearing substrate combinations have generally met this requirement by permanently affixing the substrate directly onto the back of the lenticular lens or by directly printing the patterned image onto the back of the lenticular lens.

Such substrates in combination with lenticular lenses are disclosed in U.S. Pat. No. 5,488,452 to Goggins, U.S. Pat. No. 5,568,313 to Steenblik et al., U.S. Pat. No. 5,543,964 to Taylor et al., U.S. Pat. No. 5,461,495 to Steenblik et al., U.S. Pat. No. 4,935,335 to Fotland, U.S. Pat. No. 4,082,433 to Appledorn et al., U.S. Pat. No. 3,937,565 to Alasia, U.S. Pat. No. 3,538,632 to Anderson, U.S. Pat. No. 3,119,195 to Braunhut, the disclosures of which are hereby incorporated by reference in their entirety.

To date, lenticular, or decoding, lenses have not been incorporated into a folding puzzle. By incorporating combination decoding lens/encoded image portions into a folding picture puzzles, the number of assembled images that can be formed by the folded puzzle is significantly increased when compared to a similar puzzle not having these portions, and the versatility of the puzzle is improved. There is no teaching or suggestion in the art of the invention as described and claimed herein.

SUMMARY OF THE INVENTION

The present invention provides a folding picture puzzle having many novel and entertainment enhancing aspects and features. One aspect of the invention provides a folding picture puzzle capable of continually folding in a first forward direction to form assembled images without having to unfold in a second reverse direction. In this embodiment, the invention provides a fold-through picture puzzle comprising a sheet having a defined length, width and shape comprising: an outer periphery; an edge defining an aperture in said base sheet, the aperture having a defined length, width, area and shape; and a foldable peripheral portion having a defined area completely surrounding said aperture and being operable to fold-through said aperture. The foldable peripheral portion bears one or more combination decoding lens/encoded image portions which forms an assembled decoded image when the puzzle is folded.

In some embodiments of the invention, the aperture is disposed approximately centrally in the sheet. In other embodiments, the length and width of the aperture are approximately equal and approximate one-fourth to three-fourths of the length or width of the sheet. The aperture can be formed from plural connecting, bisecting or intersecting incisions in the sheet. In yet other embodiments, the area of the peripheral portion can be approximately three-fourths to fifteen times the area of the aperture.

While some embodiments of the invention provide an asymmetrically shaped sheet and/or aperture, other embodiments provide a symmetrically shaped sheet and/or aperture. Still other embodiments of the invention provide a sheet and/or aperture shaped as a circle, triangle, oval, square, rectangle, pentagon, parallelogram, hexagon, heptagon, octagon, multi-sided polygon having nine or more sides or a three- to twenty-pointed star.

Another aspect of the invention provides a folding picture puzzle having plural stacked sheets that share a common complementary portion. This aspect provides a folding puzzle which can fold to a large number of configurations forming a corresponding large number of assembled decoded images. This particular aspect is especially useful in making an entirely new form of interactive book. Thus, one embodiment of the invention provides a folding puzzle comprising plural superposed attached sheets each having a respective defined length, width, area and shape, and one or more of each comprising a foldable peripheral portion which bears a combination decoding lens/encoded image portion wherein the foldable peripheral portion is operable to fold and form an assembled decoded image. Each of the plural superposed attached sheets can be attached to another at a respective complementary location.

In another embodiment, the invention provides an interactive fold-through book comprising plural superposed attached sheets wherein:

- each of the sheets has a defined shape, an edge defining an aperture having a defined shape, an outer periphery and a foldable peripheral portion bearing one or more combination decoding lens/encoded image portions completely surrounding the aperture for folding through the aperture;
- the aperture of each sheet superposes the aperture of another sheet;
- each of the sheets is attached to another at a respective complementary location, of a respective foldable peripheral portion adjacent a respective aperture; and
- one or more assembled decoded images are formed by folding said foldable peripheral portions.

By folding the sheet in a variety of ways along specific fold-lines, assembled decoded images will form. The assembled decoded images include any type of image. As well, the surface of the sheet can bear additional texture enhancing features. The assembled images can include text, graphics, colored patches, buildings, people, animals, food, toys, weapons, machinery, caricatures, fanciful figures, logos, letters, spaceships, and air, land or water borne vehicles, geometric patterns, irregular shapes, and the like, i.e. any image imaginable.

Another aspect of the invention provides a fold-through 3-dimensional puzzle which can fold through and, in some embodiments, invert itself. The 3-dimensional puzzle can be formed from circles, ellipses, ovals, triangles, rectangles, squares, pentagons, parallelograms, hexagons, heptagons, octagons, polygons having nine to twenty sides and combinations thereof. Thus, one embodiment of the invention provides a fold-through 3-dimensional puzzle comprising a single foldable sheet having a defined 2-dimensional shape, said sheet comprising:

- edges defining plural juxtapositionable apertures;
- a foldable peripheral portion bearing one or more combination decoding lens/encoded image portions and completely surrounding said plural apertures for folding through said plural apertures when juxtapositioned; and
- an outer periphery having plural mutually attachable portions;
- the sheet being folded to form a 3-dimensional object having a defined shape.

In another embodiment, the fold-through 3-dimensional puzzle comprises plural attached, foldable sheets which together form a 3-dimensional object wherein at least two of said sheets have an edge defining an aperture completely surrounded by a respective peripheral portion which is operable to fold-through the apertures, and the apertures are juxtapositionable. Some embodiments of the fold-through 3-dimensional puzzle can employ additional incisions to facilitate folding of the sheet and folding of the foldable peripheral portions through the apertures.

Another embodiment of the invention provides a fold-through 3-dimensional puzzle comprising plural attached, foldable sheets which together form a 3-dimensional object having a defined shape, wherein:

- each sheet has a defined 2-dimensional shape and comprises a respective outer periphery;
- at least two of said sheets each has an edge defining an aperture completely surrounded by a respective foldable peripheral portion bearing one or more combination decoding lens/encoded image portions, said apertures being juxtapositionable to one another;
- said sheets are attached adjacent respective outer peripheries; and
- assembled decoded images are formed when said sheets are folded.

In another aspect, the invention is a novelty piece which can be folded in different orientations to present a plurality of different sides or faces bearing assembled decoded images. This aspect of the invention provides a novelty piece that can be folded in a first position to show one face or side, opened to a second position to show a different second face or side, opened to a third position to show different third face or side and finally opened to a fourth position to show a different fourth face or side. One or more of the sides will bear cooperating combination decoding lens/encoded image portions which portions, when placed adjacent one another, will form an assembled decoded image.

Another aspect of the invention provides a folding picture puzzle comprising a sheet which includes a plurality of folding lines which divide the sheet into plural sections, wherein each section includes an upper surface and a bottom surface. The sections are arranged in a matrix of rows and columns, and two or more of the sections comprise a combination decoding lens/encoded image portion. The puzzle also includes cut-lines which extend from the outer periphery of a first edge of the sheet toward a second edge of the sheet. The cut-lines are provided along one or more fold-lines between the rows and one or more fold-lines between the columns. As the sections and combination decoding lens/encoded image portions are folded toward one another, assembled encoded images are formed. The sections of the sheet and the sheet itself can be shaped as desired and are preferably geometrically shaped.

In one embodiment, the invention provides a folding puzzle comprising a sheet defined by opposing edges and having four or more fold-lines dividing the sheet into nine or more sections. Four or more of the sections each bears a combination decoding lens/encoded image portion. At least two cut-lines are provided in the puzzle, and the cut-lines are provided along one or more fold-lines. According to the desired complexity of the puzzle and the desired number of puzzle sections, the number and location of fold-lines, the shape of the sheet and puzzle sections, and the number of cut-lines can be varied.

In a preferred embodiment, the puzzle comprises a rectangular or square shaped sheet having four columns defined by three fold-lines and three rows defined by two fold-lines. Further, two of the columns are divided at their ends by cut-lines which are coincident with portions of the respective column forming fold-lines and the ends of the three rows are the divided by cut-lines which are coincident with portions of the respective row forming fold-lines.

Another preferred embodiment comprises a sheet including a plurality of folding lines provided therein so as to divide the sheet into twelve sections, each section including an upper surface and a lower surface and the sections being arranged in a matrix including three first, second and third rows and first, second, third and fourth columns. Cut-lines are provided between adjacent first sections of the second and third columns, respectively, and between adjacent third sections of the second and third columns, respectively. Additional, cut-lines are provided between adjacent first, second and third sections of the first column and between adjacent first, second and third sections of the fourth column. At least four sections of the puzzle bear respective combination decoding lens/encoded image portions which when place adjacent one another form assembled decoded images. In another preferred embodiment, the sheet includes a plurality of fold-lines which divide the sheet into sixteen section, each section having an upper and lower surface and the sections being arranged in first, second, third and fourth columns and first, second, third and fourth rows. Cut-lines are provided between adjacent first sections of the second and third columns, respectively, and between adjacent fourth sections of the second and third columns, respectively. Cut-lines are also provided between one or more of the adjacent first and second, second and third and third and fourth sections of the first and fourth columns.

Another aspect of the invention provides a folding picture puzzle comprising a geometrically shaped sheet divided into two or more major sections, wherein at least two of the sections bear combination decoding lens/encoded image portions. Adjacent ones of the major sections are separated by major fold-lines and one or more of the major sections can include 0, one or more minor fold-lines dividing the major section into one or more minor sections. In a preferred embodiment, the sheet includes one or more cut-lines along one or more minor fold-lines such that at least one major section having minor fold-lines, minor cut-lines and minor sections is formed. The major and/or minor sections can independently bear combination decoding lens/encoded image portions that form one or more assembled decoded images when the puzzle is folded along major and/or minor fold-lines.

Another aspect of the invention provides a picture puzzle comprising a cross-shaped sheet divided into top, bottom, left, right and central major sections, wherein at least two of the sections bear combination decoding lens/encoded image portions. In another preferred embodiment, the sheet is shaped as a square, rectangle, triangle, hexagon, pentagon, heptagon or octagon. By proper selection of the number and disposition of major and minor fold-lines in the sheet, a major and/or minor section will be independently shaped as a square, rectangle, triangle, hexagon, pentagon, heptagon or octagon. In another preferred embodiment, the sheet is shaped as a three to six pointed star. In another preferred embodiment, the cut-lines extend from a first portion of the periphery of the sheet toward the center of the sheet, and/or toward a second portion of the periphery of the sheet. In another preferred embodiment, the cut-lines extend from one or more of the apexes of a geometrically shaped sheet.

Another aspect of the invention provides a folding picture puzzle that is a multi-sided novelty piece. The novelty piece is foldable in different orientations to present a plurality of different sides at least one of which bears an assembled lenticular image formed from two separate combination decoding lens/encoded image portions. The multi-sided novelty piece is formed from one or more flexible sheets bearing at least one combination decoding lens/encoded image portion on each side of the sheet. Adhesive is applied at preselected locations of the sheet and the sheet is folded thereby aligning the adhesive sections as required. The novelty pieces are then cut out of the sheet. The final novelty piece is foldable to a first position to form a first face comprising two first face halves. The novelty piece is then foldable to a second position to form a second face comprising two second face halves. The novelty piece is then foldable to a third position to form a third face comprising two third face halves. The novelty piece is then foldable to a fourth position to form a fourth face comprising two fourth face halves. Finally, the novelty piece is foldable to the first position again. At least one of the four faces bears a decoded image comprising a first combination decoding lens/encoded image portion superposing a face half and a second combination decoding lens/encoded image portion superposing the respective other face half. In a preferred embodiment, each of the four faces independently comprises an assembled decoded image formed from two combination decoding lens/encoded image portions.

In other preferred embodiments of the invention, one or more parts of the folding picture puzzle are edible or made from comestible materials. For example, the decoding lens will comprise a substantially transparent candy material, and the sheet can comprise a flexible material containing juice syrup or residue.

In other preferred embodiments, two or more folding picture puzzles according to the invention are included within a book, magazine, packet, newspaper, pamphlet, brochure, leaflet, flyer, booklet, or pad. A single folding picture puzzle can also comprise two or more sheets, and a single sheet can comprise two or more folding picture puzzles.

Yet another aspect of the invention provides a method of preparing a folding picture puzzle comprising one or more combination decoding lens/encoded image portions, the method comprising the following steps of:

1) providing a flexible or foldable sheet; and
2) placing an encoded image portion on a section of said sheet and superposing said encoded image portion with a decoding lens that decodes the encoded image portion; or
3) attaching a preformed combination decoding lens/encoded image portion to a section of said sheet.

The method of the invention can further comprise one or more of the following steps:

a) repeating step 2) one or more times;
b) repeating step 3) one or more times;
c) placing on said sheet one or more image portions that are not encoded;
d) folding or scoring said puzzle to facilitate folding;
e) placing one or more apertures in said sheet to form a fold-through picture puzzle;
f) providing one or more additional sheets;
g) folding and cutting said sheet;
h) cutting and folding said sheet;
i) applying adhesive to one or more sections of said sheet;
j) assembling a plurality of said folding picture puzzles; and
k) including one or more of said folding picture puzzles in a book, magazine, packet, newspaper, pamphlet, brochure, leaflet, flyer, booklet, or pad.

The method of the invention can be performed on conventional equipment already used in the printing industry and/or in the lenticular products industry.

Other features, advantages and embodiments of the invention will be apparent to those skilled in the art by the following description, accompanying examples and appended claims.

BRIEF DESCRIPTION OF THE DRAWINGS

The following drawings are part of the present specification and are included to further demonstrate certain aspects of the invention. The invention may be better understood by reference to one or more of these drawings in combination with the detailed description of the specific embodiments presented herein. In all the drawings herein, a dashed line indicates a fold line, a bold or heavy solid line indicates an incision or aperture, and a thin solid line indicates a boundary.

FIGS. 5*a*–5*b* are top and bottom, respectively, plan views of a preferred folding picture puzzle comprising a square sheet divided by fold-ines into four major sections and 16 minor sections, wherein four of the minor sections bear combination decoding lens/encoded image portions and wherein the puzzle comprises four diagonal cut-lines.

FIG. 6 is a perspective view of a preferred folding picture puzzle comprising a six pointed star shaped sheet divided by fold-lines into triangular sections, wherein all of the triangular sections bear combination decoding lens/encoded image portions and wherein the puzzle comprises one cut line.

FIGS. 7*a*–7*d* are perspective views of a preferred folding picture puzzle which continually folds in a first direction to form faces bearing decoded images formed from plural combination decoding lens/encoded image portions.

FIG. 8*a* is a top plan view of the puzzle of FIG. 7*c* now shown bearing an assembled image comprising two combination decoding lens/encoded image portions.

FIG. 8*b* is a top plan view of the puzzle of FIG. 7*d* now shown bearing an assembled image comprising two combination decoding lens/encoded image portions and two image portions that are not encoded, i.e., two unencoded image portions.

DETAILED DESCRIPTION OF THE INVENTION

The present invention is different than known folding picture puzzles primarily in that it is a folding picture puzzle bearing at least one combination decoding lens/encoded image portion that form an assembled decoded image. In some embodiments, the puzzle is a fold through picture puzzle. Generally, the folding picture puzzle comprises a foldable sheet bearing cooperating combination decoding lens/encoded image portions. By folding the sheet, different combination decoding lens/encoded image portions juxtapose one another and one or more assembled decoded images are formed.

By "sheet" is meant an article, such as a film, paper, paperboard, or thin cardboard, or other article having a sheet type structure. The sheet can be a laminate, it can be of a unitary construction and it can comprise plural sheet sections that are affixed to one another. The sheet can be made of any foldable or flexible material. Such materials include, by way of example and without limitation, polymer, paper, plastic or rubber film or laminate, laminated paper, cloth, screen, mesh, paperboard, cardboard, other material known to those of ordinary skill in the art and combinations thereof.

The sheet will generally have a defined length, width, area and shape. Although the sheet can be any useful shape, shapes such as a pentagon, a circle, a square, an octagon, a triangle, a hexagon, a rectangle, an ellipse, a heptagon, a rectangle, a parallelogram, a multi-pointed star having three to twenty points, a letter of the alphabet, and a multi-sided polygon having nine to twenty sides are particularly contemplated. It should be noted that in preferred embodiments the sheet will generally be symmetrically shaped.

Figure 1A:
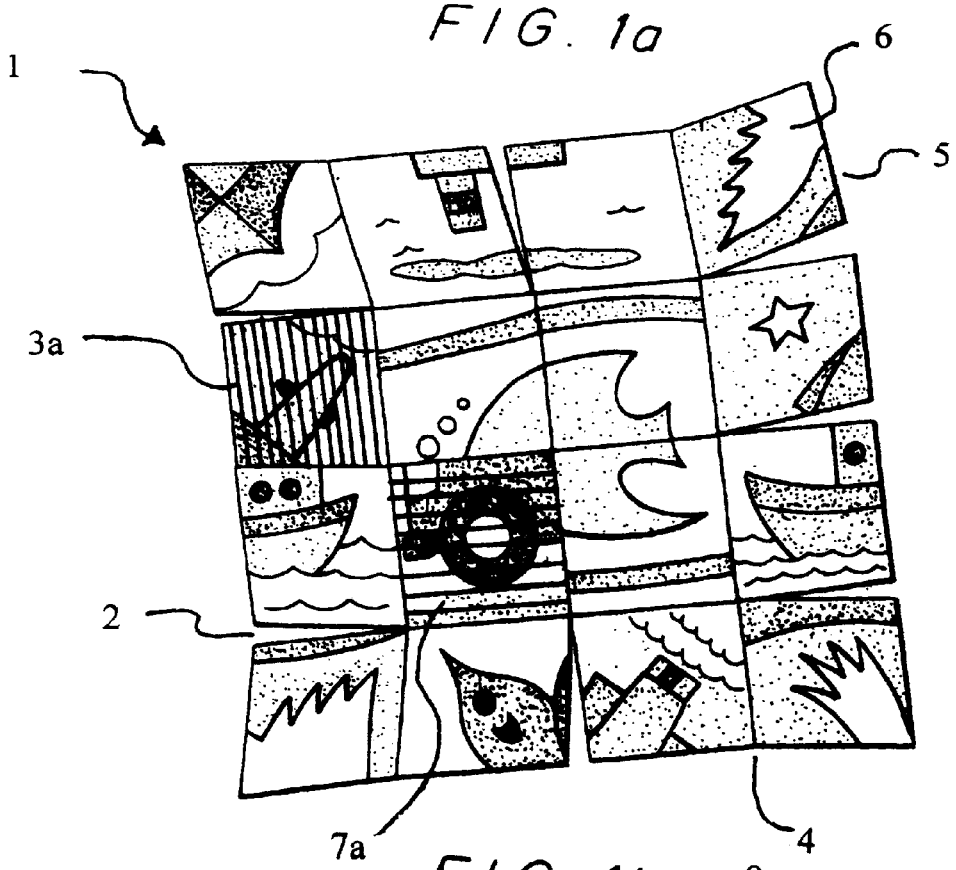
FIGS. 1*a*–1*b* are top and bottom, respectively, plan views of a preferred folding picture puzzle comprising a square sheet divided by fold-lines into sixteen puzzle sections, wherein eight of the puzzle sections bear combination decoding lens/encoded image portions.
Figure 1B:
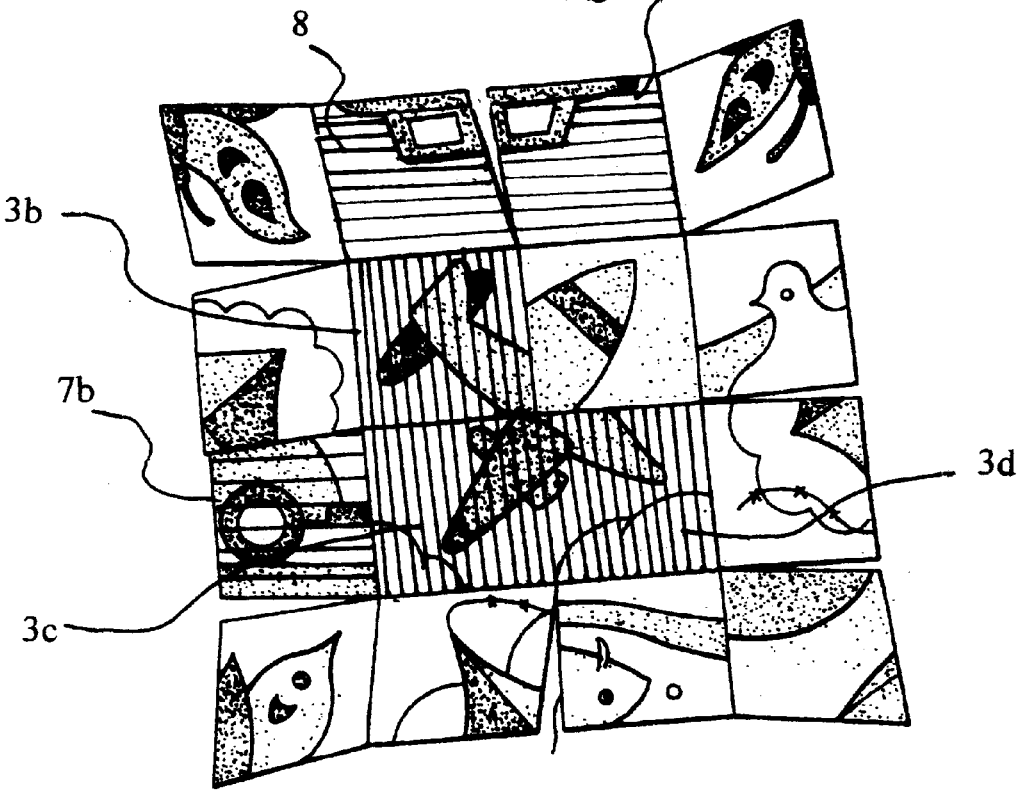

FIG. 1*a* depicts a top perspective view of a folding picture puzzle (1), as disclosed in U.S. Pat. No. 5,445,380, which has been modified and improved according to the invention to include a plurality of combination decoding lens/encoded image portions. FIG. 1*b* depicts a bottom perspective view of the picture puzzle (1). In this first embodiment, the puzzle (1) comprises sixteen puzzle sections having upper and lower surfaces. Each puzzle section bears an image portion (2) or combination decoding lens/encoded image portion (3). The puzzle sections are formed from six fold-lines (4) and eight cut-lines (5). The puzzle (1) is folded along the fold-lines to form assembled images and/or assembled decoded images. The relative orientations of the image portions and combination decoding lens/encoded image portions will necessarily be different such that the correct assembled images or assembled decoded images can be formed. When the puzzle (1) is folded correctly, the combination decoding lens/encoded image portions (3*a*–3*d*) or (7*a*–7*b*, 8, 9) will be correctly juxtaposed to form the intended assembled decoded images. Not all sections of the puzzle need to bear an image portion or a combination decoding lens/encoded image portion.

Figure 2A:
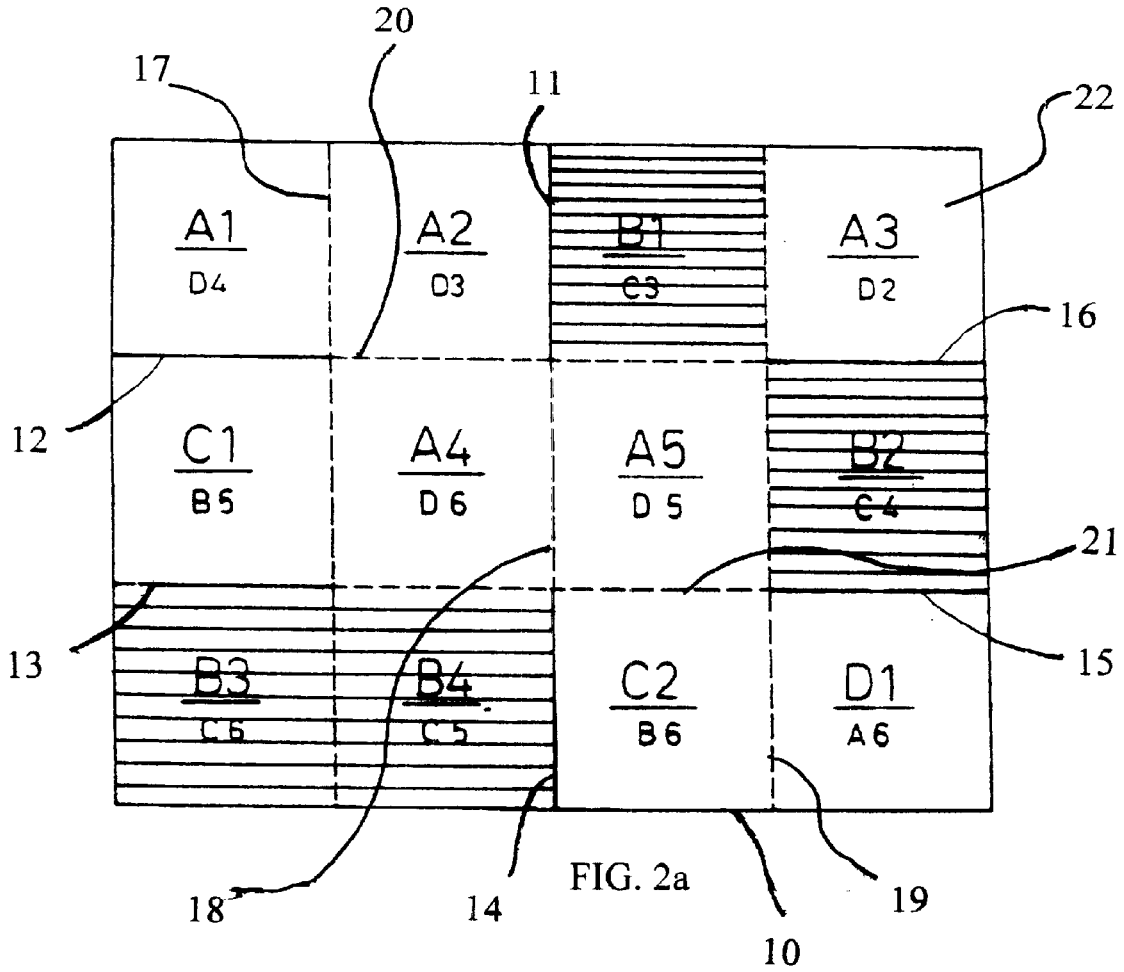
FIG. 2*a* is a top plan view of a preferred folding picture puzzle comprising a square sheet divided by fold-ines into twelve puzzle, wherein six of the puzzle sections bear combination decoding lens/encoded image portions.

FIG. 2*a* depicts a top plan view of a folding picture puzzle (10), as disclosed in U.S. Pat. No. 5,564,704, which has been modified and improved according to the invention. This puzzle (10) is divided into twelve puzzle sections (22) by five fold-lines (17–21) and six cut-lines (11–16). Some of the sections (B1–B6, sections B5 and B6 are on the bottom surface of the puzzle) bears a combination decoding lens/encoded image portion. The remaining puzzle sections can optionally and independently bear unencoded image portions, i.e., image portions that are not encoded. Although not shown, the puzzle (10) has a bottom surface which also bears image portions or combination decoding lens/encoded image portions. When the puzzle (10) is folded correctly, the combination decoding lens/encoded image portions (A1–A6) will be disposed correctly adjacent one another to form one or more assembled images.

Figure 2B:
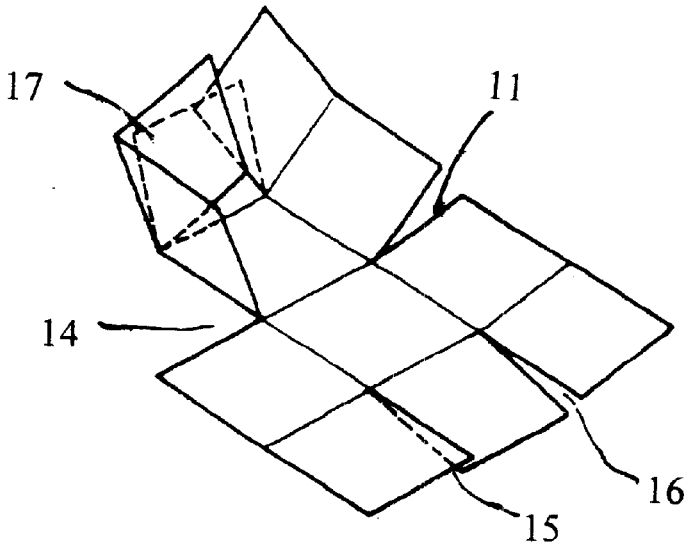
FIG. 2*b* is a perspective view of the folding puzzle of FIG. 2*a* after it has been partially folded.

FIG. 2*b* depicts a perspective view of the puzzle (10), wherein the puzzle is being folded to form a part of a cube. Accordingly, the folding picture puzzle according to the invention can also form 3-dimensional shapes bearing two or more combination decoding lens/encoded image portions on its surface which when juxtaposed form an assembled image.

Figure 3A:
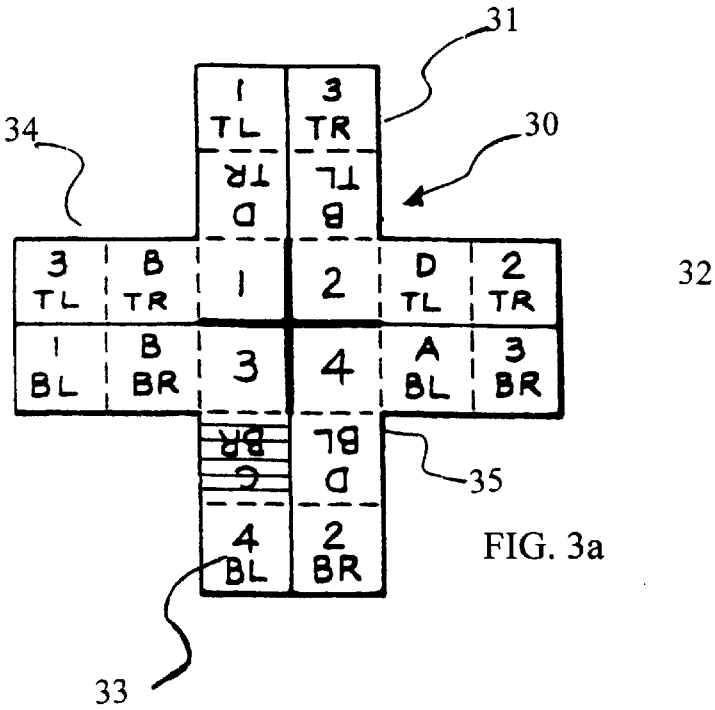
FIGS. 3*a*–3*b* are top and bottom, respectively, plan views of a preferred folding picture puzzle comprising a cross-shaped sheet divided into top, bottom, left, right and central major sections, wherein four of the sections bear combination decoding lens/encoded image portions.
Figure 3B:
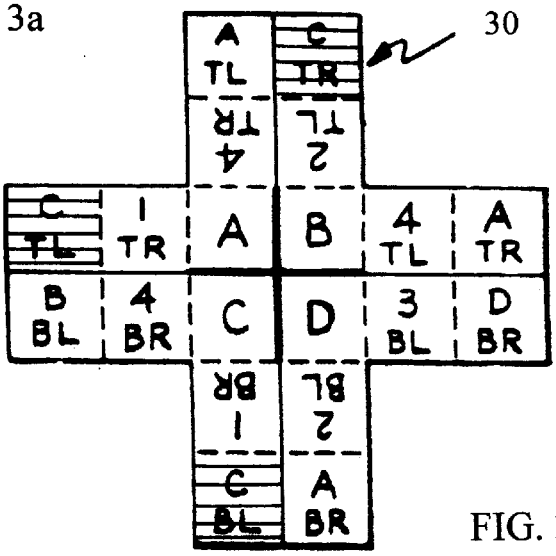

FIG. 3*a* depicts a top plan view of the puzzle (30), as disclosed in U.S. Pat. No. 4,170,355, which has been improved and modified according to the invention. FIG. 3*b* depicts a bottom plan view of the puzzle (30). The puzzle comprises a cross-shaped sheet divided into top, bottom, left, right and center major sections (31–35) which are themselves each divided into four minor sections, respectively. The minor sections are shown with indicia indicating their relation to one another and their relative orientations. The orientations indicate the manner in which corresponding combination decoding lens/encoded image portions, and optionally unencoded image portions, should be placed on the sheet such that correct assembled decoded images are formed. In this embodiment, only the minor sections labeled "C" bear combination decoding lens/encoded image portions; however, one or more of the other major and/or minor sections can also bear combination decoding lens/encoded image portions.

Figure 3C:
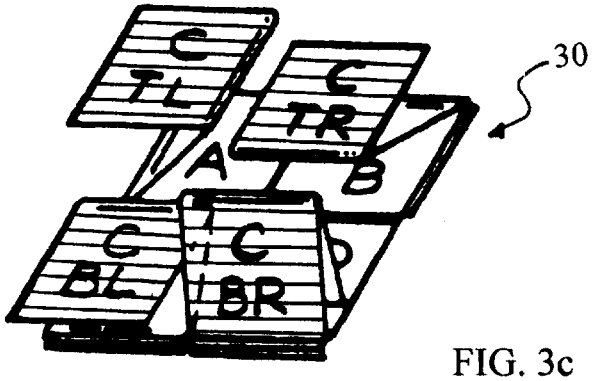
FIG. 3*c* is a perspective view of the puzzle of FIGS. 3*a*–3*b* after is has been folded.

The puzzle is folded along fold-lines to bring related combination decoding lens/encoded image portions adjacent one another to form one or more assembled decoded images. For example, FIG. 3*c* is a perspective view of the puzzle (30) after it has been almost completely folded to form an assembled decoded image. Although the puzzle (30) has been shown without cut-lines, it can include those cut-lines to further increase the difficulty level of the puzzle and enhance the entertainment value of the puzzle.

A fold-through picture puzzle comprises a sheet comprising at least the following three elements: an outer periphery, an edge defining pentagon-shaped aperture and a foldable peripheral portion bearing cooperating images (not shown) completely surrounding the aperture. By "fold-through" is meant that the foldable peripheral portion of the sheet will be operable to fold through the aperture. The sheet has an outer periphery which defines an outer edge or boundary of the base. The outer periphery is separated from the aperture by the foldable peripheral portion. The foldable peripheral portion will have a defined area and will completely surround the aperture, i.e. the edge defining the aperture will not intersect with the outer periphery of the sheet. The foldable peripheral portion will be operable to fold through the aperture in the sheet by folding along plural fold-lines. The aperture will have a defined length, width, area and shape. The length and width of the aperture can be, but need not be, equivalent and will generally approximate one-fourth to three-fourths of the length and width of the sheet. In a preferred embodiment, the length and width of the aperture are equivalent. In another preferred embodiment, the length and width of the aperture approximate one-third to two-thirds, or more preferably about one-half, the length and width of the sheet. The aperture can be shaped as described above for the sheet of the invention. The shape of the aperture can be different than the shape of the sheet. For example, a circular sheet having a square shaped aperture formed by folding plural flap sections along plural fold-lines out of the plane of the sheet. In one preferred embodiment, the aperture is symmetrically shaped. In another preferred embodiment (not shown), the aperture is shaped similar to respective sheet.

The aperture is preferably formed from plural connecting, intersecting or bisecting incisions once plural flap sections are folded along fold-lines above or below a plane along which sheet lies. The plural incisions can, but need not necessarily, intersect or bisect each other at approximately centrally disposed point in the sheets. In various embodiments, two to twenty, preferably two to ten and more preferably two to eight, plural connecting, intersecting or bisecting incisions are employed. The plural incisions are preferably evenly spaced and can, but need not necessarily, extend radially from a central point in their respective sheets. Thus, the plural incisions can radiate, for example, toward the vertices or sides of the sheets. Although the sheet of the invention can comprise additional incisions which extend from the outer periphery inward, the incisions which form the aperture are not intended to intersect the outer periphery or the additional incisions. In other embodiments of the fold-through picture puzzle, an aperture is formed from plural intersecting or connecting incisions that radiate from a central point. The shape of the apertures can be chosen and prepared as described in U.S. Pat. No. 5,735,520 to Matos.

As indicated above, the relative defined length, width area and shape of the aperture and peripheral portion of the sheet of the invention can vary. Generally, the defined area of the peripheral portion will be sufficient to permit bearing a suitable number and size of cooperating combination decoding lens/encoded image portion. Also, the defined area of the aperture will generally be sufficient to permit fold-through of a corresponding peripheral portion. Accordingly, in a preferred embodiment, the defined area of a peripheral portion approximates three-fourths to fifteen fold, more preferably one to ten fold, and even more preferably about three fold, the area of a corresponding aperture.

Figure 4:
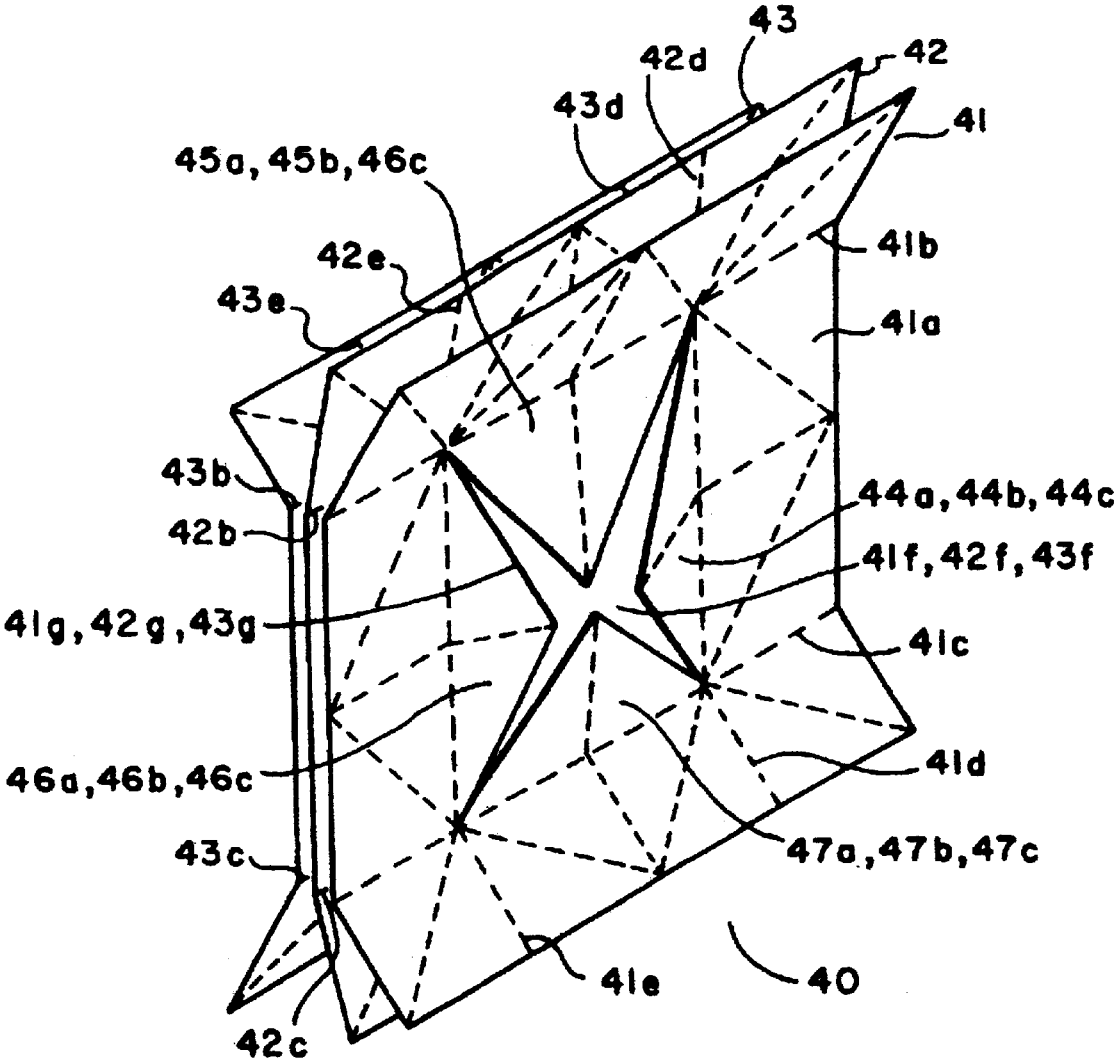
FIG. 4 is a perspective view of one embodiment of the interactive fold-through book of the invention.

FIG. 4 depicts a fold-through picture puzzle as disclosed in U.S. Pat. No. 5,735,520, wherein the puzzle (40) has been modified and improved according to the invention. In another aspect of the present invention, the folding picture puzzle can comprise plural sheets to form a multi-ply folding picture puzzle which can be used as an interactive book. In a preferred embodiment, the multi-ply folding picture puzzle is a fold-through picture puzzle. Thus, reading a book can now be an interactive, as opposed to passive, activity by employing the proper combination of a fold-through picture puzzle embodiment and plural cooperating image portions. The fold-through picture puzzle can form 3-dimensional configurations when folded. In some embodiments, the 3-dimensional configurations can be related to corresponding cooperating image portions on the surfaces of the sheet of the puzzle to tell a story.

FIG. 4 depicts an exemplary embodiment of an interactive fold-through picture puzzle book. Book (40) comprises plural superposed sheets (41), (42) and (43) bearing plural cooperating combination decoding lens/encoded image portions (not shown), common and complementary apertures **(41*f*), (42*f*) and (43*f*), and foldable peripheral portions (41*a*), (42*a*, not shown) and (43*a*, not shown). By folding the peripheral portions (41*a*), (42*a*) and (43*a*) simultaneously or sequentially through respective apertures (41*f*), (42*f*) and (43*f*)**, the book is able to fold through itself while forming a variety of 3-dimensional configurations and assembled decoded images.

Although the book (40) comprises three similarly shaped sheets, it can comprise two or more, preferably two to twenty, more preferably two to ten and most preferably two to six, similarly or differently shaped plural superposed sheets. The shape of each of said plural sheets is independently selected at each occurrence from the shapes indicated above. Plural sheets (41), (42) and (43) can each be any shape as contemplated above for the individual sheets.

By "common and complementary apertures" is meant that apertures **(41*f*), (42*f*) and (43*f*), of respective superposed plural sheets (41), (42) and (43), overlap, i.e. are superposed, or are at least partially superposed and are located at complementary locations on their respective base sheets. The shape of apertures (41*f*), (42*f*) and (43*f*) need not be the same; however, each is shaped to permit fold-through of foldable peripheral portions (41*a*), (42*a*) and (43*a*) through itself. Since the apertures (41*f*), (42*f*) and (43*f*) can be differently shaped, respective flap portions (44*a–c*), (45*a–c*), (46*a–c*) and (47*a–c*)** can also be differently shaped.

Each of the plural superposed sheets (41), (42) and (43) are preferably attached to another at respective complementary sections of respective foldable peripheral portions **(41*a*), (42*a*) and (43*a*) to maintain them together. Each complementary section will be adjacent a respective common and complementary aperture. Thus, superposed sheets (41), (42) and (43) can be attached at complementary flap sections (44*a–c*), (45*a–c*), (46*a–c*) and (47*a–c*), along complementary fold-lines (41*b–d*), (42*b–d*) and (43*b–d*), respectively, along complementary edges (41*g*), (42*g*) and (43*g*)**, respectively, and/or combinations thereof.

Generally, some form of adhesive, staple or tape will be used to attach plural superposed sheets (41), (42) and (43), and, virtually any type of adhesive, staple or tape is suitable. In preferred embodiments, an adhesive or double-sided tape is used.

According to the particular combination of shapes of sheets and apertures employed in making a folding picture puzzle book, a particular folding process or series of folding steps will be preferred some or which are not described herein. As above, two or more, and up to all, of the puzzle sections can bear corresponding combination decoding lens/encoded image portions and optionally and independently, unencoded image portions.

Other aspects of the fold-through picture puzzles are generally as described in U.S. Pat. No. 5,735,520 to Matos except that the present puzzles will additionally bear at least one combination decoding lens/encoded image portions which can form an assembled decoded image.

FIGS. **5*a* and 5*b* are top and bottom plan views, respectively, of the folding picture puzzle disclosed in U.S. Pat. No. 2,327,875, wherein the puzzle (50) has been modified and improved according to the invention by adding thereto at least two combination decoding lens/encoded image portions (56*a*–56*d*) which when placed correctly side-by-side form an assembled decoded image. The puzzle (50) is divided into four square-shaped major puzzle sections (52) which themselves are each divided into four triangular minor puzzle sections (51*a*–51*d*). In this embodiment, the cut-lines extend diagonally along the fold-lines (54) from one edge of the puzzle sheet to an adjacent edge of the puzzle (see 53) or from an apex of the puzzle sheet toward the center of the puzzle sheet (see 55**). The disposition of the cut-lines and fold-lines can be changed as desired to provide a particular puzzle.

The sheet of the puzzle can also be star-shaped as depicted in FIG. **5*c* which is a top plan view of a puzzle (60) as disclosed in U.S. Pat. No. 2,327,876 but which has been modified and improved according to the invention to include plural combination decoding lens/encoded image portions. In this embodiment, each section of the top side and the bottom side (not shown) of the puzzle (60) bears a combination decoding lens/encoded image portion. The puzzle (60) comprises plural puzzle sections (62), each bearing a respective combination decoding lens/encoded image portion, and a single cut-line (61)**.

FIGS. **7*a*–7*d* are perspective views of a fold-through picture puzzle (70) as disclosed in U.S. Pat. Nos. 5,759,328 and 5,833,789 both to Rosendale et al. except that is has been modified and improved according to the invention to include two or more combination decoding lens/encoded image portions. The puzzle has multiple surfaces and is constructed from a single or plural sheets which have been folded and selectively glued in specific locations to form a four-faced puzzle. The faces are formed by the pairs of face halves (71 and 72, 77***a* and 77*b*, 83*a* and 83*b*, 78*a* and 78*b*, respectively). As the puzzle is folded, unfolded and manipulated as indicated by the arrows (71, 72, 75, 76, and 79–82), the four faces of the puzzle are formed sequentially. One or more of each of the faces will comprise two or more combination decoding lens/encoded image portions.

For example, FIG. 8*a* depicts a top plan view of the puzzle (70), as depicted in FIG. 7*d*, bearing an assembled decoded image formed from two combination decoding lens/encoded image portions (83*c*, 83*d*). In much the same manner, FIG. 8*b* depicts a top plan of the puzzle (70), as depicted in FIG. 7*c*, bearing an assembled decoded image formed from two combination decoding lens/encoded image portions (73*c*, 73*d*) and two regular image portions (84, 85) which bear images that are readily discernible and not encoded.

Figure 9B:
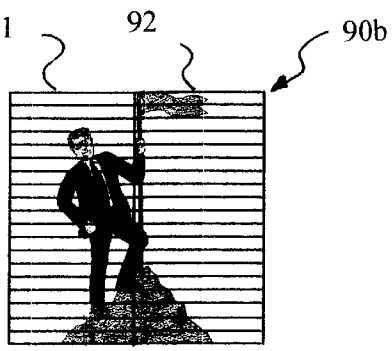
FIGS. 9*a*–9*b* are top plan views of two assembled images that are formed from two cooperating combination decoding lens/encoded image portions.
Figure 9A:
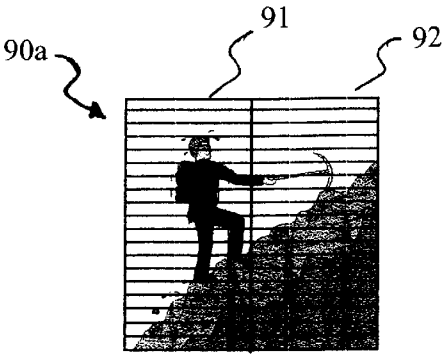

Aside from the unique feature of a folding picture puzzle bearing at least one combination decoding lens/encoded image portions, the puzzles according to the invention also preferably include the following features. Two or more of the puzzle sections can each bear two source image portions which are used to make respective combination decoding lens/encoded image portions. For example, FIGS. 9*a* and 9*b* depict assembled decoded images (90*a*, 90*b*) each of which comprises two combination decoding lens/encoded image portions (91, 92). The only difference between the assembled decoded images is that they are observable by viewing the juxtaposed two combination decoding lens/encoded image portions (91, 92) at different viewing angles. For example, when the two combination decoding lens/encoded image portions are viewed at a first angle, the first assembled image (90*a*) is formed, and when viewed from a second angle, the second assembled image (90*b*) is formed. Accordingly, the invention provides a folding picture puzzle comprising one or more puzzle sections bearing more than one source image thereby increasing the number of images which can be borne by the puzzle without having to increase the number of puzzle sections in the puzzle. Additionally, the invention provides a method of increasing the number of viewable assembled images which can be formed by a folding picture puzzle without requiring an increase in the number of puzzle sections in the puzzle, the method comprising the step of adding to the puzzle at least one combination decoding lens/encoded image portions, wherein the combination decoding lens/encoded image portion comprise at least two source images each of which is viewable from a different respective viewing angle.

Another unique feature of the folding picture puzzle according to the invention is that another dimension of complexity can be added to the puzzle by including in the puzzle at least three combination decoding lens/encoded image portions, wherein:

- a first one of the combination decoding lens/encoded image portions comprises at least a first source image and a second source image;
- a second one of the combination decoding lens/encoded image portions comprises at least said first source image and a third source image;
- a third one of the combination decoding lens/encoded image portions comprises one or more of said first source image, said second source image, said third source image, and a fourth source image.

When a puzzle having this construction is operated, the first and second combination decoding lens/encoded image portions will together form a first assembled decoded image when viewed from a first angle but will not do so when viewed from a second angle. Further, the second and third combination decoding lens/encoded image portions will together form a first and/or third assembled decoded image when viewed from a first angle or the first and third combination decoding lens/encoded image portions will together form a first and/or second assembled decoded image when viewed from a first angle. The viewing angles can be independent of or dependent upon one another.

Figure 10B:
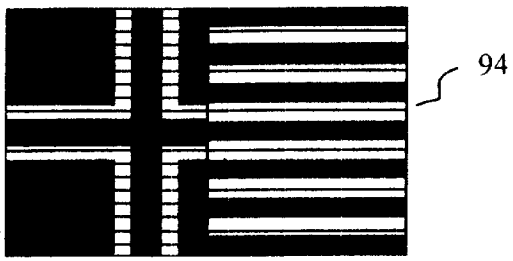
FIGS. 10*a*–10*b* are top plan views of an assembled image and an unassembled image that are formed from two combination decoding lens/encoded image portions when viewed from first and second angles, respectively.
Figure 10A:
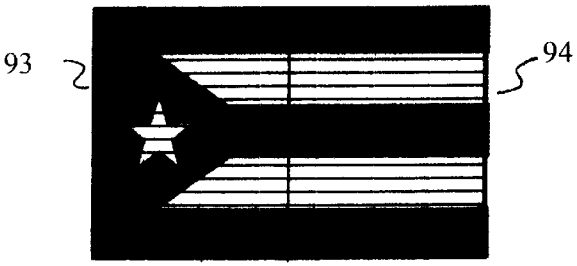
Figure 10C:
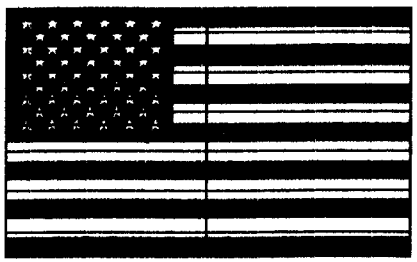
FIG. 10*c* is a top plan view of an assembled image formed from one of the combination decoding lens/encoded image portions of FIG. 10*b* and another combination decoding lens/encoded image portion.
Figure 12A:
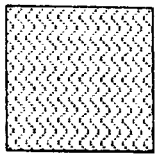
FIGS. 12*a*–12*l* are top plan views of various exemplary embodiments of the decoding lens used in the present invention.
Figure 12B:
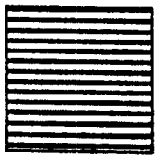
Figure 12C:
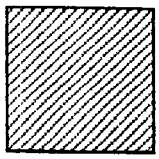
Figure 12D:
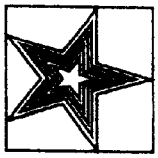
Figure 12E:
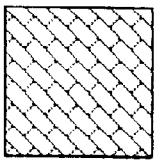
Figure 12F:
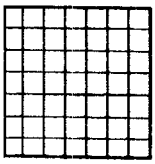
Figure 12G:
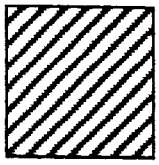
Figure 12H:
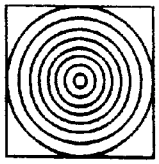
Figure 12I:
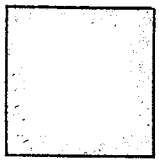
Figure 12K:
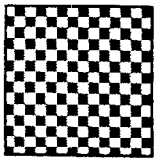
Figure 12J:
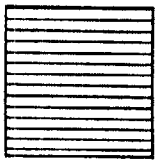
Figure 12L:
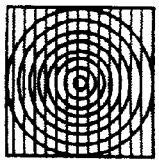

FIGS. 10*a*–10*c* depict various assembled and unassembled images (95*a*–95*c*, respectively) formed from their respective combination decoding lens/encoded image portions (93 and 94, 93 and 94, 96 and 94). When the two combination decoding lens/encoded image portions (93, 94) are placed side-to-side, i.e., edge-to-edge, and viewed from a first angle, as depicted in FIG. 9*a*, they form an assembled decoded image of a Texas flag. However, when the portions (93, 94) are viewed from a second angle, as depicted in FIG. 9*b*, they form an unassembled decoded image comprising two different flag portions. Then, when the second (94) and a third (96) portion are placed side-to-side and viewed from a first angle, as depicted in FIG. 9*c*, they form an assembled decoded image of an American flag; however, they form an unassembled image when viewed from a second angle. Thus, a single pair of juxtaposed combination decoding lens/encoded image portions can form a plurality of assembled or unassembled decoded images.

The sheet will bear at least two, and preferably a patchwork of plural, cooperating combination decoding lens/encoded image portions on its top and/or bottom surfaces. The sheet can also bear a patchwork of plural cooperating image sections on its top and/or bottom surfaces. When the sheet is folded properly along specific fold-lines, the cooperating image portions, and/or cooperating combination decoding lens/encoded image portions, will be juxtaposed and form one or more assembled images or assembled decoded images. As indicated above, any imaginable image or decoded image can be formed. As well, the sheet can also bear texture, entertainment and/or interaction enhancers such as smooth film, particulates, ridges, bumps, depressions, and the like; odor emitting agents such as perfumes; flavored agents such as food flavoring; and combinations thereof.

By "combination decoding lens/encoded image portion" is meant a section of the puzzle comprising a decoding lens section superposing a respective encoded image section which the decoding lens will be adapted to reveal or decode. The decoded image can be affixed or printed directly onto the back or smooth surface of the decoding lens or it can be disposed between the decoding lens and a substrate affixed to the back surface of the decoding lens. When the decoding lens/encoded image portions are placed correctly side by side an assembled decoded image is formed.

Figure 11:
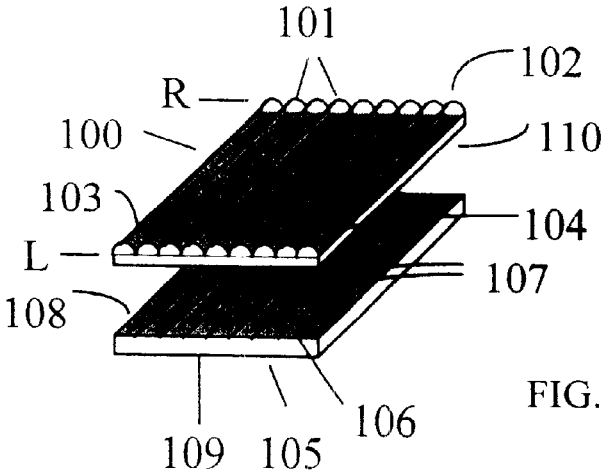
FIG. 11 is an exploded view of a lenticular lens superposing a lenticular image.

Any known combination decoding lens/encoded image will suffice for the invention. Essentially any decoding lens will operate according to the invention. In the exemplary embodiment depicted in FIG. 11, the lenticular lens (100) comprises a plurality of closely spaced or adjacent, substantially equally sized, parallel, linear lenticules (101) disposed on the front surface (102). The spacing, or the nodes (103), between the lenticules (101) is minimal, and each lenticule has an apex (104). The substrate (105) comprises a lenticular lens-resolvable linear-patterned encoded image (the encoded image not shown) which itself comprises a plurality of image-bearing linear encoded image sections (106) and nulls (107) together forming the encoded image. The linear-patterned encoded imaged is disposed on the front surface (108) of the substrate (105) adjacent the rear surface (110)

of the lens (100). The substrate (105) is separable from the lens (100). When the apexes (104) and the nodes (103) of the lens (100) are aligned with the image sections (106) and the nulls (107) of the substrate, a decoded image is formed.

Decoding lenses are commercially available and can be made of plastic, rubber, polymer, glass, silicates or combinations thereof. A suitable decoding lens will be light transmissive, transparent, translucent or semi-transparent. Such lenses can also be made flexible or rigid. Although the lenticules as depicted in the attached figures have a conical profile, they can also have a semicircular, square, blocked, rectangular, triangular or other equivalent profile. The profile can resemble any shape or combination thereof which will operate according to the invention.

Although the decoding lenses depicted in the attached figures can include substantially uniformly-sized and straight lenticules, the lenticules need not be uniform in size or straight. The lenticules can have different heights, width and curvatures. The lenticules can also be shaped as pyramids, stars, circles, ovals, triangles, squares, hemispheres, rectangles or other geometric, regular, irregular, symmetric or asymmetric shapes. FIGS. 12*a*–12*l* depict exemplary non-limiting embodiments of the decoding lens. It is only required that the construction of the lens be such that the lens can align correctly with the corresponding linear-patterned image on a substrate and form an assembled image therefrom.

The decoding lenses of the invention are readily commercially available and comprise all such lenses that can filter out color from an image, add color to an image, distort an image, filter out light, permit passage of selected light waves, selectively view portions of and/or form an assembled image of spaced-apart image portions of an image. These lenses include fresnel, colored, color filtering, light filtering, lenticular, spheric, aspheric, paraboloid, hyperboloid, concave-convex, concave-concave, convex-convex, grating, diffracting, refracting, prismatic, diffusing, focusing, magnifying, and reducing lenses and combinations thereof. Decoding lenses that are particularly suitable for the present invention are disclosed in U.S. Pat. No. 5,461,495 to Steenblik et al., U.S. Pat. No. 4,082,433 to Appeldorn et al., U.S. Pat. No. 3,937,565 to Alasia, U.S. Pat. No. 3,119,195 to Braunhut, U.S. Pat. No. 2,514,814 to Towne, U.S. Pat. No. 3,538,632 to Anderson, U.S. Pat. No. 5,543,964 to Taylor et al., U.S. Pat. No. 4,935,335 to Fotland, U.S. Pat. No. 5,568,313 to Steenblik et al., U.S. Pat. No. 5,206,761 to Ogino, U.S. Pat. Nos. 4,597,634, 4,717,239 and 5,002,364, the disclosures of which are hereby incorporated in their entirety by reference.

The decoding lenses of the invention can be stacked or otherwise arranged to individually, additively, synergistically, or cooperatively decode an encoded or lenticular image or image portion. For example, a color filtering lens can be combined, either by attachment or by being made integral therewith, with a lenticular lens to both filter out a color from and decode the linear pattern in an encoded image disposed beneath the combination lens. The present invention includes lenses having simple and complex construction such as lenses having a single optic layer or single decoding layer as well as combination decoding lenses comprising plural individual decoding lenses that have been attached or otherwise stacked.

A folding picture puzzle according to the invention will preferably comprise at least two, and more preferably three or more decoding lenses which shape can be independently selected at each occurrence from any known shape. In particular embodiments, the shape of the plural decoding lenses will independently be selected from square, triangle, rectangle, parallelogram, hexagon, pentagon, heptagon, octagon, multi-sided polygon, multi-pointed star, geometric form with rounded corners, oval, ellipse, regular, irregular, symmetric, asymmetric, and combinations thereof. Generally, the shape of the decoding lens will at least approximate the shape of a respective underlying puzzle section.

Although not required by the invention, the decoding lenses of the invention will preferably be substantially planar although they can be flat, arched or curved. The decoding lenses can also include indicia such as graphics, markings or text on either a front or rear surface thereof or within the lens itself. The graphics, markings and text included with such a lens can cooperate with the decoded image formed by the lens to form yet another image. For example, if eyes are printed on the lower surface of a decoding lens and the decoding lens forms a decoded partial facial image, the decoded facial image together with the eyes on the bottom surface of the decoding lens will together form a full facial image. In this manner, decoded images can be combined with unencoded images to form yet more images.

As used herein, the term "encoded image" means an image having one or more encoded image portions which can be decoded with a decoding lens according to the invention to form an unencoded/decoded image or unencoded/decoded image portion. An encoded image can have within it a hidden, not readily discernible, masked, colored, light activated, heat activated, water activated, water revealable, chemical agent revealable, scrambled, unassembled, scattered, patterned, invisible, visible image or combinations thereof wherein when said image is viewed through a decoding lens according to the invention, a decoded or readily discernible image is formed. The encoded image can require one or more different decoding lenses to form a decoded image. The encoded image can comprise graphics, markings, text, indicia, designs and combinations thereof. The decoded image can be an image of essentially any real or fictional person, place or thing. The encoded image can also be a part of an unencoded or readily discernible or readily viewable image, i.e., the encoded image can be hidden or masked by, embedded within or combined with a readily discernible or readily viewable image or portion thereof. A first combination decoding lens/encoded image portion can be made to form an assembled image with an image portion that is not encoded or with a second combination decoding lens/encoded image portion.

The term "lenticular lens-resolvable linear-patterned image" refers to a patterned image comprising a plurality of linear image-bearing sections which when properly viewed through a correspondingly designed lenticular decoding lens will form a decoded image or plural decoded image portions. The linear-patterned images can be but need not be substantially uniform in size. Although the linear-patterned encoded images depicted in some of the figures include straight and parallel linear image-bearing sections, the sections can be shaped as curved lines, geometrical shapes arranged linearly, and otherwise. It is only necessary that the linear-patterned encoded images be operable to cooperate with the lenticular lens to form a decoded image when the two are properly engaged. These patterned images can be Moire patterned images. Such assembled images can indicate depth, motion, stereoscopic views, other such projections or dimensions, or combinations thereof. These patterned images are particularly useful for forming different images when viewed from different angles.

Folding picture puzzles which can be combined with decoding lenses according to the present invention include, among others, the puzzles disclosed in U.S. Pat. Nos. 2,327,875 and 2,327,876 to H. Edborg, U.S. Pat. No. 2,655,382 to C. Belsky, U.S. Pat. No. 4,170,355 to S. Finkin, U.S. Pat. No. 5,445,380 to N. Polsky, U.S. Pat. No. 5,735,520 to Matos, U.S. Pat. Nos. 5,759,328 and 5,833,789 both to Rosendale et al. and combinations thereof. Each of these folding picture puzzles will bear at least two combination decoding lens/encoded image sections which when placed side-by-side in the correct orientation will form at least one and preferably at least two decoded images.

The sheet of the invention, as described above, is generally considered a 2-dimensional object or puzzle, when placed flat along a plane, which forms 3-dimensional configurations when folded through itself. However, as described below, the sheet of the invention can be provided in the form of a folding or fold-through 3-dimensional puzzle which forms 2-dimensional and additional 3-dimensional configurations when folded or when folded through itself. Accordingly, one aspect of the invention provides a fold-through 3-dimensional puzzle which can be folded through itself and, in some embodiments, inverted. Suitable fold-through 3-dimensional puzzles are described in U.S. Pat. No. 5,735,520 to Matos.

The fold-through 3-dimensional puzzle can be shaped as a cube, pyramid or other geometric 3-dimensional structure. Preferred 2-dimensional shapes for the sheet of the 3-dimensional puzzle include the square, rectangle, triangle, pentagon, hexagon, ellipse, circle and combinations thereof.

The shape of the 3-dimensional puzzle will be dictated by the shape of the sheet(s) employed in constructing the puzzle. Plural sheets having different or similar shapes can be used to construct the puzzle. Preferred shapes for the fold-through 3-dimensional puzzle include a cube, a pyramid, a sphere, and an irregular shape such as of an animal, person, building, vehicle, weapon, food, caricature or other object.

A fold-through 3-dimensional puzzle will have plural, preferably two or more, more preferably two to twenty, even more preferably two to ten, juxtapositionable apertures each being completely surrounded by a respective peripheral portion for folding through said apertures when juxtapositioned.

When a puzzle comprises a single sheet folded to form a 3-dimensional object, the sheet will comprise edges defining plural juxtapositionable apertures. When a puzzle comprises plural sheets affixed to form a 3-dimensional object, at least two, preferably two to twenty, more preferably two to ten, of the sheets will each have an edge defining a juxtapositionable aperture completely surrounded by a respective foldable peripheral portion operable to fold through each aperture. It is only necessary that the apertures be juxtapositionable when corresponding sheets are folded during the fold-through process of the invention. The plural sheets can be attached adjacent respective outer peripheries.

The folding picture puzzle of the invention can be made according to a variety of processes. A first preferred method includes the steps of:

1) providing a flexible or foldable sheet; and
2) placing an encoded image portion on a section of said sheet and superposing said encoded image portion with a decoding lens that decodes the encoded image portion; or
3) attaching a preformed combination decoding lens/encoded image portion to a section of said sheet.

Step 2) can include printing or outputting the encoded image portion onto a section of the surface of the sheet or it can include attaching onto a section of the surface of the sheet a substrate bearing an encoded image portion. This step can also include the steps of superposing the encoded image portion with a decoding lens, aligning the decoding lens with the encoded image portion, and attaching, e.g. adhering, the decoding lens to the encoded image portion and/or the sheet section bearing the encoded image portion.

A preformed combination decoding lens/encoded image portion can be prepared by outputting an encoded image portion directly onto the rear surface of a decoding lens or by outputting an encoded image portion onto a substrate which is than adhered to decoding lens.

Steps 1)–3) can be repeated until the desired folding picture puzzle is formed. The sheet can also include one or more image portions that are not encoded, and these portions can be placed on the sheet either before or after placement of a combination decoding lens/encoded image portion.

In order to facilitate folding the puzzle, the sheet can be scored or folded before or after the puzzle is assembled. The can also be cut and/or folded in the order desired to form specific folding picture puzzels.

If needed, adhesive can be applied to specific sections of the sheet to facilitate preparation of a particular type of puzzle. For example, the multi-ply fold-through puzzles of Matos and the fold-through puzzle of Rosedale require placing adhesive on specific sections of the sheet in order to form the desired puzzle. Further, the fold-through puzzles also require cutting one or more apertures into the sheet.

The folding picture puzzles of the invention can be included in media such as a book, magazine, packet, newspaper, pamphlet, brochure, leaflet, flyer, booklet, or pad. Accordingly, it will be necessary to assemble or prepare one or more of said folding picture puzzles, which are the same or different, and include them in one or more of the above media. These puzzles can be included during the printing of these media by printing their images directly onto the pages of the media, by adding them into a medium after the medium has been printed, by binding them with the medium or by inserting them into the medium.

When a two or more combination decoding lens/encoded image portions are adjacent one another on the sheet of the folding puzzle, it will generally be necessary to space the edges of the combination decoding lens/encoded image portions from one another to facilitate folding. The spacing between the edges is generally equal to about 0–10 times the combined thickness of the combination decoding lens/encoded image portion and its respective puzzle section. A thinner decoding lens is preferred. The combination decoding lens/encoded image portions of a puzzle will be oriented, shaped, sized and disposed as required on a sheet to form a particular folding puzzle. Although, the exemplary folding puzzles depicted in the figures have specific folding patterns, puzzles having other folding patterns are within the scope of the invention.

The above is a detailed description of particular embodiments of the invention. It is recognized that departures from the disclosed embodiments may be made within the scope of the invention and that obvious modifications will occur to a person skilled in the art. Those of skill in the art should, in light of the present disclosure, appreciate that many changes can be made in the specific embodiments which are disclosed herein and still obtain a like or similar result without departing from the spirit and scope of the invention. All of the embodiments disclosed and claimed herein can be made and executed without undue experimentation in light of the present disclosure.

What is claimed is:

1. A folding picture puzzle comprising:

a foldable sheet having upper and lower surfaces divided by plural fold-lines into a plurality of puzzle sections; and at least three combination decoding lens/encoded image portions disposed on one or both of said surfaces;

wherein, when viewed from a first angle, one or more assembled first decoded images are formed when said puzzle is folded along one or more of said fold-lines into a first folded-orientation and one or more of said one or more combination decoding lens/encoded image portions is placed edge-to-edge alongside another of said combination decoding lens/encoded image portions or alongside an image portion that is not encoded and when viewed from a different second angle a different decoded image is formed; and wherein a first one of the combination decoding lens/encoded image portions comprises at least a first source image and a second source image;

a second one of the combination decoding lens/encoded image portions comprises at least said first source image and a third source image;

a third one of the combination decoding lens/encoded image portions comprises one or more of said first source image, said second source image, said third source image, and a fourth source image; and said first and second combination decoding lens/encoded image portions together form a first assembled decoded image when viewed from a first angle and an unassembled decoded image when viewed from a second angle.

2. The puzzle of claim 1 further comprising a plurality of cooperating image portions that are not encoded, wherein one or more assembled images are formed when said puzzle is folded along one or more of said fold-lines.

3. The puzzle of claim 1 further comprising at least one aperture, wherein said puzzle is one of a fold-through picture puzzle, a fold-through book and a fold-through 3-dimensional puzzle.

4. The puzzle of claim 3, wherein said puzzle has four faces and at least one of said faces comprises an assembled decoded image.

5. The puzzle of claim 1, wherein a majority of said puzzle sections each includes a respective combination decoding lens/encoded image portion.

6. The puzzle of claim 1, wherein at least one of said plural combination decoding lens/encoded image portions forms an assembled image with another image portion on the puzzle which is not encoded.

7. The puzzle of claim 1, wherein said puzzle comprises one or more of:

at least four puzzle sections;

four to one hundred puzzle sections;

at least two fold-lines; and at least one cut-line.

8. The puzzle of claim 1, wherein the shape of said sheet is selected from the group consisting of a cross, letter of the alphabet, pentagon, a circle, a square, an octagon, a triangle, a hexagon, a rectangle, an ellipse, a heptagon, a rectangle, a parallelogram, a multi-pointed star having three to twenty points, a letter of the alphabet, a multi-sided polygon having nine to twenty sides and combinations thereof.

9. The puzzle of claim 1, wherein said sheet is made from a material selected from the group consisting of polymer, paper, plastic or rubber film or laminate, laminated paper, cloth, screen, mesh, paperboard, cardboard, and combinations thereof.

10. The puzzle of claim 1, wherein the upper and lower surfaces of the sheet each bears one or more combination decoding lens/encoded image portions.

11. The puzzle of claim 10, wherein at least one of the upper and lower surfaces of the sheet bears one or more image portions that are not encoded.

12. The puzzle of claim 1, wherein two or more of the one or more combination decoding lens/encoded image portions have different orientations and dispositions.

13. The puzzle of claim 1, wherein the decoding lens of the one or more combination decoding lens/encoded image portions is independently selected at each occurrence from the group consisting of lenses that can filter out color from an image, add color to an image, distort an image, filter out light, permit passage of selected light waves, selectively view portions of, form an assembled image of spaced-apart image portions of an image and combinations thereof.

14. The puzzle of claim 13, wherein the lens is independently at each occurrence one of a fresnel, colored, color filtering, light filtering, lenticular, spheric, aspheric, paraboloid, hyperboloid, concave-convex, concave-concave, convex-convex, grating, diffracting, refracting, prismatic, diffusing, focusing, magnifying, and reducing lens and a combination thereof.

15. The puzzle of claim 1, wherein one or more parts of the puzzle are edible or made from a comestible material.

16. The puzzle of claim 1, wherein two or more of said folding picture puzzles, which are the same or different, are included within a book, magazine, packet, newspaper, pamphlet, brochure, leaflet, flyer, booklet, or pad.

17. A folding picture puzzle comprising at least one puzzle section bearing at least three combination decoding lens/encoded image portions comprising at least two source images, wherein an assembled first decoded image is viewable at a first viewing angle and a different second decoded image is viewable at a different second viewing angle when said puzzle is folded to form a first folded-orientation; and wherein a first one of the combination decoding lens/encoded image portions comprises at least a first source image and a second source image;

a second one of the combination decoding lens/encoded image portions comprises at least said first source image and a third source image;

a third one of the combination decoding lens/encoded image portions comprises one or more of said first source image, said second source image, said third source image, and a fourth source image; and said first and second combination decoding lens/encoded image portions together form a first assembled decoded image when viewed from a first angle and an unassembled decoded image when viewed from a second angle.

18. The puzzle of claim 17, wherein a first of said one or more combination decoding lens/encoded image portions forms an assembled image with one or both of an unencoded image portion and a second of said one or more combination decoding lens/encoded image portions.

19. The puzzle of claim 17 further comprising one or more images that are not encoded.

20. A folding picture puzzle comprising plural puzzle sections bearing a combination decoding lens/encoded image portion comprising at least two source images, wherein an assembled decoded image is viewable at a first viewing angle and an unassembled decoded image is viewable at a different second viewing angle when said puzzle is folded to form a first folded-orientation; and a different assembled decoded image is viewable at a first viewing angle and a different unassembled decoded image is viewable at a different second viewing angle when said puzzle is folded to form a second folded-orientation.

21. The folding picture puzzle of claim 20 further comprising plural unencoded puzzle sections bearing unencoded images.

22. The folding picture puzzle of claim 21, wherein at least one of the combination decoding lens/encoded image portions can form an assembled image with at least one of the unencoded puzzle sections.

23. The folding picture puzzle of claim 20, wherein two or more of the combination decoding lens/encoded image portions have different orientations and/or dispositions.

24. The folding picture puzzle of claim 23, wherein the puzzle comprises a foldable substrate bearing the combination decoding lens/encoded image portions.

25. The folding picture puzzle of claim 24, wherein the foldable substrate is a sheet having upper and lower surfaces.

26. The folding picture puzzle of claim 20, wherein two or more of the combination decoding lens/encoded image portions have different orientations and/or dispositions.

27. The folding picture puzzle of claim 26, wherein the puzzle comprises a foldable substrate bearing the combination decoding lens/encoded image portions.

28. The folding picture puzzle of claim 27, wherein the foldable substrate is a sheet having upper and lower surfaces.

29. A picture puzzle comprising plural puzzle sections bearing a combination decoding lens/encoded image portion comprising at least two source images, wherein an assembled first decoded image is viewable at a first viewing angle and an unassembled second decoded image is viewable at a different second viewing angle when said puzzle sections are placed in a first puzzle-solving arrangement; and an assembled third decoded image is viewable at a third viewing angle and an unassembled fourth decoded image is viewable at a different fourth viewing angle when said puzzle sections are placed in a second puzzle-solving arrangement.

* * * * *